US006565732B1

(12) United States Patent
Kitada et al.

(10) Patent No.: US 6,565,732 B1
(45) Date of Patent: May 20, 2003

(54) GOLD PLATING SOLUTION AND PLATING PROCESS

(75) Inventors: Katsutsugu Kitada, Kanagawa (JP); Yoshiro Shindo, Kanagawa (JP)

(73) Assignee: Tanaka Kikinzoku Kogyo K.K., Tokyo (JP)

( * ) Notice: Subject to any disclaimer, the term of this patent is extended or adjusted under 35 U.S.C. 154(b) by 0 days.

(21) Appl. No.: 09/830,567

(22) PCT Filed: Oct. 7, 1999

(86) PCT No.: PCT/JP99/05540

§ 371 (c)(1),
(2), (4) Date: May 7, 2001

(87) PCT Pub. No.: WO01/27354

PCT Pub. Date: Apr. 19, 2001

(51) Int. Cl.[7] ..... C25D 3/48
(52) U.S. Cl. ..... 205/267
(58) Field of Search ..... 205/266, 267

(56) References Cited

U.S. PATENT DOCUMENTS 3,879,270 A * 4/1975 Kowalski ..... 205/263
5,277,790 A * 1/1994 Morrissey ..... 205/248
6,087,516 A * 7/2000 Kitada ..... 556/110
6,165,342 A * 12/2000 Kuhn ..... 205/247
6,183,545 B1 * 2/2001 Okuhama et al. ..... 205/239 X

FOREIGN PATENT DOCUMENTS

| | | |
|---|---|---|
| JP | 6-108992 | 8/1991 |
| JP | 7-166392 | 6/1995 |
| JP | 10-226690 | 8/1998 |
| JP | 411080970 A * | 3/1999 |
| JP | 11-293487 | 10/1999 |

* cited by examiner

*Primary Examiner*—Donald R. Valentine
(74) *Attorney, Agent, or Firm*—Rothwell, Figg, Ernst & Manbeck

(57) ABSTRACT

The present invention provides a non-cyanide electrolytic gold plating solution comprising a gold compound, as a source material for gold, selected from the group consisting of a gold salt and a gold complex, a buffering agent, an organic brightener, and a conductive salt, wherein 1,2-ethanediamine is contained in the gold plating solution. The gold plating solution has excellent liquid stability in a bath and causes no change in the physical properties of the deposited gold or no decomposition of the solution during the operation of gold plating. The gold plating solutions include both a type in which a bis(1,2-ethanediamine) gold complex is used as a source material for gold, and a type in which a gold salt is used as a source material for gold. The gold plating solution is an unprecedentedly good electrolytic gold plating solution in which the hardness, purity, state of the deposited crystals and so on can be controlled.

14 Claims, 2 Drawing Sheets

GOLD PLATING SOLUTION AND PLATING PROCESS

CROSS REFERENCE TO RELATED APPLICATION

This application is a 35 USC 371 National Phase Entry Application from PCT/JP99/05540, filed Oct. 7, 1999, and designating the U.S.

FIELD OF THE INVENTION

The present invention relates to a gold plating solution free from sulfite ions, has good stability and is capable of being used for extended periods, and also to a process for gold plating using the gold plating solution.

BACKGROUND OF THE INVENTION

Gold plating has been traditionally used for decorative purposes including decoration of tableware, and is now widely used in the electronics industries due to the good electrical properties of gold.

Most conventional gold plating solutions contain toxic gold potassium cyanate (potassium tetracyanoaurate). Recently, however, non-cyanide (i.e., cyanide-free) gold plating solutions have been in increasing demand in view of problems resulting from the use of a cyanide bath, such as concerns about safety at work sites, wastewater treatment, and corrosion of resists or the like used in semiconductor elements. Accordingly, various types of non-cyanide gold plating solutions have been proposed.

For example, a type of non-cyanide gold plating solution has been reported in the J. Am. Chem. Soc. 1951, vol. 73, p. 4722, which contains bis(1,2-ethanediamine) gold trichloride as a gold compound. Bis(1,2-ethanediamine) gold trichloride is widely known to be produced by a reaction of chloroauric acid with ethylenediamine (monohydrate) in a solvent (diethyl ether) at ambient temperature. The present inventors has proposed a novel process for producing bis(1,2-ethanediamine) gold trichloride chloride produced by the process to form a gold-plated layer with a good appearance. In such a plating solution or process, however, control Of e hardness, purity and state of the gold crystals deposited by the plating has yet been impossible.

On the other hand, widely available non-cyanide gold plating solutions often contain $Na_3Au(SO_3)_2$ as a gold salt. In a gold plating solution bath containing $Na_3Au(SO_3)_2$, however, sulfite ions in the gold plating solution are highly unstable and, therefore, may be readily oxidized by oxygen generated from an anode or that present in the atmosphere, causing a spontaneous reduction in the concentration of sulfite ions in the gold plating solution. As a result, the stability of gold complexes in the gold plating solution is decreased, leading to inconvenience such as changes in the physical properties of the electrolytically deposited materials or decomposition of the plating solution.

SUMMARY OF THE INVENTION

Figure 1:
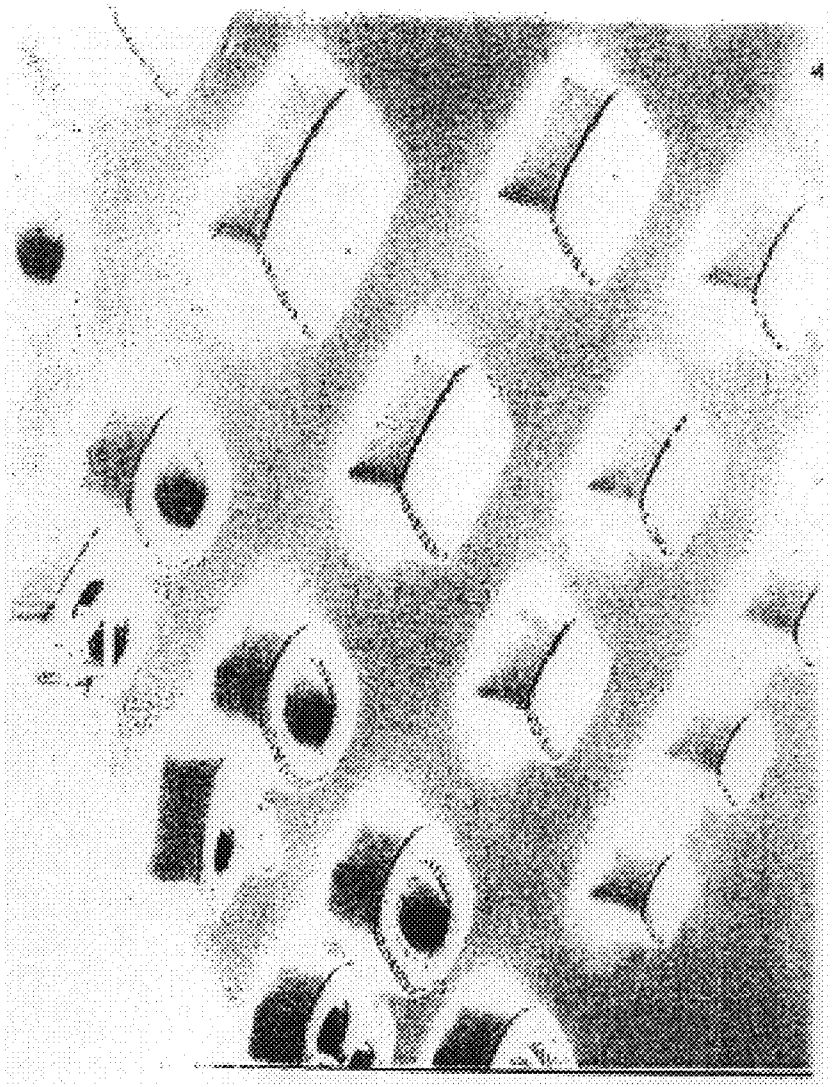
FIG. 1 shows a scanning electron microscope (SEM) photograph of the structure of deposited particles on the surface of a gold-plated layer.

The present inventors have now succeeded in providing an electrolytic gold plating solution which has a more prolonged stability and which is impervious to long-term operation, and also a plating process using the electrolytic gold plating solution by the addition of 1,2-ethanediamine to the gold plating solution.

The present inventors have made intensive and extensive studies on non-cyanide electrolytic gold plating solutions. As a result, the inventors have found that the gold plating solution as defined in a first embodiment exhibits excellent properties.

The plating solution defined in the first embodiment is a non-cyanide electrolytic gold plating solution comprising a gold compound selected from the group consisting of a gold salt and a gold complex as a source material for gold, a buffering agent, an organic brightener and a conductive salt, in which 1,2-ethanediamine is contained in the gold plating solution.

The gold plating solution, in which 1,2-ethanediamine is contained, has excellent stability in a bath and is less susceptible to change with regard to the physical properties of the deposited gold and decomposition of the gold plating solution during the gold plating process. The gold plating solution includes both a type in which a bis(1,2-ethanediamine) gold complex is used as a source material for gold and a type in which a gold salt is used as a source material for gold. In either case, 1,2-ethanediamine is contained in the gold plating solution.

The gold plating solution is an unprecedentedly good electrolytic gold plating solution, capable of controlling the hardness, purity, crystalline state and so on of the deposited gold.

According to a second embodiment, a non-cyanide electrolytic gold plating solution is described which comprises: a bis(1,2-ethanediamine) gold complex, as a gold compound, in such an amount that the gold content in the gold plating solution falls within the range from 2 to 30 g/l; 1,2-ethanediamine sulfate at a concentration of 0.1 to 2.5 M; an inorganic potassium salt as a conductive salt; an organic carboxylic acid as a buffering agent; and a heterocyclic compound containing at least one heteroatom as an organic brightener.

In the non-cyanide electrolytic gold plating solution, a bis(1,2-ethanediene) gold complex is used as a source material. The bis(1,2-ethanediamine) gold complex as used herein (i.e., a gold compound) is expressed by $Au(en)_2^{3+}$ (en: 1,2-ethanediamine). The content of the gold complex in the plating solution is 2 to 30 g/l in terms of the gold content. If the content is lower than the lower limit of the range (2 g/l), then the deposition rate of gold is decreased and is not suitable for practical use. If the content is greater than the upper limit of the range (30 g/l), then the deposition rate remains unchanged and precipitation of gold may occur. Accordingly, the content range as specified above is suitable for the desired operational environment.

1,2-Ethanediamine sulfate, one of the other constituents, is used as a complexing agent. In the gold plating solution, 1,2-ethanediamine sulfate is added at a concentration ranging from 0.1 to 2.5 M. If the concentration is lower than the lower limit of the range (0.1 M), then the compound cannot act as a complexing agent satisfactorily. If the concentration is greater than the upper limit of the range (2.5 M), then the compound cannot be completely dissolved in the gold plating solution.

The inorganic potassium salt may be potassium sulfate, potassium chloride or potassium nitrate, as defined in a fourth embodiment. This compound is added to serve as a conductive salt for the gold plating solution (i.e., the electrolyte). The inorganic potassium salt is preferably added at a concentration ranging from 1 to 100 g/l. If the concentration is lower than the lower limit of the range (1 g/l), then a conductivity satisfactory for a gold plating solution is hardly achieved. If the concentration is greater than the upper limit of the range (100 g/l), then the inorganic potassium salt cannot be completely dissolved in the plating solution.

The organic carboxylic acid serves as a buffering agent and prevents variance of the pH of the gold plating solution. The organic carboxylic acid as used herein may be an organic compound having a carboxyl group, such as acetic acid, formic acid and benzoic acid, as defined in a fifth embodiment. The organic carboxylic acid also has a similar effect to a surfactant and act as a brightener. The organic carboxylic acid is preferably added to the gold plating solution at a concentration ranging from 1 to 200 g/l. If the concentration is lower than the lower limit of the range (1 g/l), then the compound cannot act as a buffering agent satisfactorily. On the other hand, even if the compound is added at a concentration greater than the upper limit of the range (200 g/l), the effect of the compound as a buffering agent does not increase further.

The heterocyclic compound containing at least one heteroatom has a similar effect to a surfactant and serves as a brightener. As defined in a sixth embodiment, the heterocyclic compound may be a water-soluble compound containing a nitrogen atom as a heteroatom, such as thiophenecarboxylic acid, o-phenanthroline, pyridine, pyridinesulfonic acid and bipyridyl. The heterocyclic compound is preferably added at a concentration ranging from 0.1 to 10 g/l. If the concentration is lower than the lower limit of the range (0.1 g/l), then the compound cannot act as a brightener satisfactorily. On the other hand, even if the compound is added at a concentration greater than the upper limit (10 g/l), the effect of the compound on brightness does not increase further.

The invention according to a third embodiment is a non-cyanide electrolytic gold plating solution comprising a gold salt, 1,2-ethanediamine, a buffering agent, an organic brightener and a conductive salt, wherein a trivalent gold salt, as a source material for gold, and 1,2-ethanediamine are contained in the gold plating solution at a concentration of 5 to 30 g/l in terms of the gold content and at a concentration of 0.2 to 3.0 M, respectively.

The non-cyanide electrolytic gold plating solution, unlike the plating solution as defined in the second embodiment, employs a gold salt as a source material for gold. In the plating solution, conventional trivalent gold salts can be used. According to the studies made by the present inventors, it has been found that, when trivalent gold salts are used, the range of the source materials available as the raw materials can be increased, and a gold plating solution using such a trivalent gold salt is free from suifide ions and has the best overall balance in terms of long-term stability of the solution compared with a conventional sulfide gold plating solution and properties of a gold-plated layer formed using the solution.

The trivalent gold salt as used herein is most preferably one or two compounds selected from the group consisting of bis(1,2-ethanediamine) gold trichloride, gold hydroxide, potassium tetrahydroxoaurate and chloroauric acid, as defined in claim 7. When the trivalent gold salt is used, the gold plating solution hardly deteriorates over a prolonged period of time and is particularly excellent in long-term stability.

The content of the trivalent gold salt in terms of the gold content in the plating solution is within the range from 5 to 30 g/l. If the content is lower than the lower limit of the range (5 g/l), then the deposition rate of gold is decreased and is not suitable for practical use. On the other hand, the upper limit of the range, 30 g/l (in terms of the gold content), is the limit of the amount of the trivalent gold salt dissolvable in the plating solution. Accordingly, the deposition rate of gold increases as the amount of gold in the gold plating solution is increased, as long as the content of gold falls within the dissolvable limit. Therefore, the content of the trivalent gold salt can be suitably selected within the above-specified range, depending on the intended operation conditions.

1,2-Ethanediamine is used to serve as a complexing agent. The 1,2-Ethanediamine sulfate may be added to the plating solution at a concentration ranging from 0.2 to 3.0 M. If the concentration is lower than the lower limit of the range (0.1 M), then the compound cannot act as a complexing agent satisfactorily. If the concentration is greater than the upper limit of the range (3.0 M), then the compound cannot be completely dissolved. When 1,2-ethanediamine is used, gold in the plating solution is deposited in the same state as that where a bis(1,2-ethanediamine) gold complex is used. As a result, a non-cyanide electrolytic gold plating solution which is less susceptible to decomposition and having good stability can be prepared. In the case where bis(1,2-ethanediamine) gold trichloride, one of the bis(1,2-ethanediamine) gold complexes, is used to prepare a gold plating solution, the stability of the gold plating solution can be further increased by the addition of 1,2-ethanediamine.

The organic potassium salt may be potassium sulfate, potassium chloride, potassium nitrate or the like. Such an organic potassium salt is added to serve as a conductive salt in the plating solution (an electrolyte). The organic potassium salt is preferably added to the plating solution at a concentration ranging from 1 to 100 g/l. If the concentration is smaller than 1 g/l, then it is difficult to achieve a conductivity satisfactory for a gold plating solution. If the concentration is greater than 100 g/l, then the organic potassium salt cannot be completely dissolved in the plating solution.

The buffering agent as used herein is preferably one or more compounds selected from the group consisting of an organic carboxylic acid having a pK value of 2 to 6, phosphoric acid and boric acid, as defined in an eighth embodiment. The buffering agent is preferably used in such an amount that the total molar concentration of the compound or compounds is within the range from 0.05 to 1.0 M. Specific examples of the organic carboxylic acid having a pK value of 2 to 6 include citric acid, acetic acid, succinic acid, lactic acid, tartaric acid and so on. In addition, other compounds having a buffering effect, such as phosphoric acid and boric acid, may be used. Due to the buffering effect, the buffering agent can prevent variance in the pH of the non-cyanide electrolytic gold plating solution. Regardless of whether one or more of such compounds are used, the total molar concentration is preferably within the range from 0.05 to 1.0 M. If the molar concentration is lower than the lower limit of the range (0.05 M), then the compound or compounds cannot act as a buffering agent satisfactorily. On the other hand, even if the compound or compounds are added at a total molar concentration greater than the upper limit of the range (1.0 M), the effect as a buffering agent does not increase further.

The organic brightener may be one or more compounds selected from the group consisting of o-phenanthroline, bipyridyl, a derivative of o-phenanthroline and a derivative of bipyridyl, as defined in a ninth embodiment. The organic brightener is added to the gold plating solution at a total concentration ranging from 50 to 10,000 ppm. The reason for such a wide concentration range is that the solubility of the organic brightener may vary depending on the pH of the solution. If the total concentration is lower than the lower limit of the range (50 ppm), then the effect as a brightener cannot be achieved sufficiently. On the other hand, even if organic brightener is added at a total concentration greater than the upper limit of the range (10,000 ppm), the effect of improving brightness does not increase further.

The conductive salt for imparting conductivity to the plating solution may be any compound containing sulfate ions, hydrochloride ions or nitrate ions, as defined in a tenth embodiment. It is most efficient and economical to use a 1,2-ethanediamine-based compound as the conductive salt so that 1,2-ethanediamine and a conductive ion can be provided simultaneously. Therefore, it is preferable to use one or more 1,2-ethanediamine-based compounds and add the compound or compounds in such an amount that the total molar concentration of the conductive ion falls within the range from 0.05 to 5.0 M. If the total molar concentration is lower than the lower limit of the range (0.05 M), then a conductivity satisfactory for a plating solution cannot be achieved. If the total molar concentration is greater than the upper limit of the range (5.0 M), then the compound or compounds cannot be completely dissolved in the plating solution.

Alternatively, it is also possible to add any of sulfate ions, hydrochloride ions and nitrate ions in the form of sulfuric acid, hydrochloric acid or nitric acid, respectively. It is considered that such an addition is desirable for adjustment of the pH of the plating solution.

A first process for non-cyanide electrolytic gold plating using a non-cyanide electrolytic gold plating solution as described in any one of the second to sixth embodiments, the electrolytic plating being performed under the conditions of a pH of the solution of 2 to 7, a temperature of the solution of 40 to 80° C. and a current density of 0.2 to 3.5 A/dm$^2$.

In the process, the solution has a pH value ranging from 2 to 7 depending on the amount of the organic potassium salt added. No defects occur in the appearance of a gold-plated layer as long as the pH value of the plating solution falls within this range. In the case where the adjustment of the pH value is required, it is preferable to use an organic potassium salt (e.g., potassium sulfate, potassium chloride and potassium nitrate) or an organic carboxylic acid (e.g., acetic acid, formic acid and benzoic acid) which do not affect the properties of the plating solution.

The temperature of the plating solution is within the range from 40 to 80° C. If the temperature of the plating solution is lower than the lower limit of the range, then the deposition rate is decreased and is not suitable for practical use. If the temperature is higher than the upper limit of the range, then the brightness of the gold-plated layer is not only affected, but also the service life of the solution is rapidly reduced.

The current density during the electrolysis is within the range from 0.2 to 3.5 A/dm$^2$. This is to provide the desired properties the gold-plated layer, taking the pH value and liquid temperature of the plating solution into consideration.

When the gold plating solution and the process for gold plating described above are employed, the deposited gold can have the form of finer crystalline particles and a reduced hardness compared with gold deposited using a conventional gold plating solution. In general, the hardness of a metal is determined to be higher as crystalline particles of the metal become smaller. The gold plating solution and the gold plating process according to the present invention, however, enable to be deposited gold having a low hardness while remaining the form of fine crystalline particles, which is quite distinct from the gold deposited using a conventional plating solution and a conventional plating process.

For example, in a bath of a conventional gold plating solution containing $Na_3Au(SO_3)_2$, since sulfur contained in the plating solution is also deposited in the deposited gold, the same effect as that provided when particles of the deposited gold are dispersed can be produced. As a result, a hard crystalline structure is formed even though the crystalline particles are large. In contrast, in the crystalline structure provided by the plating process according to the present invention, the deposited gold has a high purity. As a result, a gold-plated layer with a low hardness can be formed which is almost similar to bulk gold and has a small transition density in the crystalline particles. The data supporting these phenomena is shown in Table 1.

TABLE 1

Comparison of Vicker's hardness of gold-plated layers

| Items | Gold plating solution of the invention | Gold plating solution of the prior art |
|---|---|---|
| Vicker's hardness | | |
| Maximum value | 69.1 | 77.4 |
| Minimum value | 64.6 | 72.2 |
| Mean value | 66.7 | 75.1 |
| Standard deviation | 2.1 | 1.9 |

(N = 30 for each solution)

Load for measurement of Micro-hardness according to Vicker's: 1 g

A process is also provided for non-cyanide electrolytic gold plating using a non-cyanide electrolytic gold plating solution as described in any one of the third and seventh to tenth embodiments, wherein the electrolytic plating is performed under the conditions of a pH of the solution of 2 to 6, a temperature of the solution of 40 to 70° C. and a current density of 0.1 to 3.0 A/dm$^2$, as defined in claim 12.

As described above, the pH value of the solution is within the range from 2 to 6. When the pH value falls within the range, no problem occurs in the appearance of the gold-plated layer. In the case where the adjustment of the pH value is required, it is preferable to use a salt of an organic acid (e.g., sulfuric acid, hydrochloric acid and nitric acid) or an organic carboxylic acid (e.g., acetic acid, formic acid and benzoic acid) which does not affect the properties of the plating solution.

The liquid temperature of the plating solution is within the range from 40 to 70° C. If the liquid temperature is lower than the lower limit of the range, then the deposition rate is decreased and is not suitable for practical use. If the liquid temperature is higher than the upper limit of the range, then the brightness of the gold-plated layer is not only affected, but also the service life of the solution is rapidly reduced.

The current density during the electrolysis is within the range from 0.1 to 3.0 A/dm$^2$. This is to provide satisfactory properties to the gold-plated layer, taking the pH value and liquid temperature of the plating solution into consideration.

When the gold plating solution and the process for gold plating described above are employed, the plating solution can have a stability superior to that defined in the first process, and can deposit gold having a low hardness while having the form of microcrystalline particles. The gold plating solution is good in long-term stability and can be used for an extended period of time.

For example, in a bath of a conventional gold plating solution containing $Na_3Au(SO_3)_2$, since sulfur contained in the plating solution is also deposited in the deposited gold, the same effect as that provided when particles of the deposited gold are dispersed can be produced. As a result, a hard crystalline structure is formed even though the crystalline particles are large. In addition, deterioration of the plating solution (e.g., precipitation of gold within a short time) may occur and stable operation over a long time is difficult, compared with the electrolytic gold plating solution according to the present invention.

In the prior art plating process using a conventional plating solution, plating of a bump having a very fine structure cannot be achieved with good accuracy. Therefore, the gold-deposited surface becomes rough after the plating and the shape of the bump is sometimes warped. By the use of the gold plating solution and the gold plating process according to the present invention, a gold-plated layer on which gold is finely deposited can be formed. Therefore, an accurate gold-plated layer can be formed even on a bump for a small-sized LSI, and the cost of a gold plating solution can be reduced.

A non-cyanide electrolytic gold plating solution according to the present invention was used to examine the long-term stability of the resultant gold-plated layer. The results are shown in Table 2. In Table 2, the stability was determined with respect to the deposition stability (i.e., deposition rate; variations in deposition; deposit hardness; etc.) of the gold-plated layer after a current of 15,000 coulombs was applied to 1 liter of the non-cyanide electrolytic gold plating solution and the gold content in the solution was adjusted to 10 g/l.

EXAMPLES

Hereinbelow, a non-cyanide electrolytic gold plating solution and a plating process using the plating solution according to the present invention will be described in more detail with reference to the following embodiments, which seem to be best modes for carrying out the present invention.

Example 1

A bis(1,2-ethanediamine) gold complex, to be used as a gold compound, was produced by the following reaction at a reaction temperature of 30° C. In the reaction, the reaction temperature is preferably within the range from 15 to 60° C. If the reaction temperature is lower than 15° C., then the reaction cannot proceed satisfactorily and the yield may be reduced. If the reaction temperature is higher than 60° C., then a reduction reaction of gold ions may occur, causing the formation of microparticles of gold.

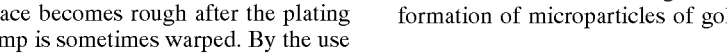

$$NaAuCl_4+2en \rightarrow Au(en)_2Cl_3+NaCl$$

Bis(1,2-ethanediamine) gold chloride, produced as above, was used to prepare a bath of a non-cyanide gold plating solution. The non-cyanide electrolytic gold plating solution had the following composition.

| | |
|---|---|
| Bis (1,2-ethanediamine) gold trichloride (gold content) | 10 g/1 |
| 1,2-Ethenadiamine sulfate | 60 g/1 |
| Potassium chloride | 60 g/l |
| Organic carboxylic acid (Citric acid) | 50 g/l |
| Heterocyclic compound (Thiphenecarboxylic acid) | 1 g/l |

The gold plating solution was used to conduct gold plating in a test pattern under the following conditions.

TABLE 2

| Items | | Unit | Lot No. 1 | 2 | 3 | 4 | 5 | 6 |
|---|---|---|---|---|---|---|---|---|
| Composition of solution | Gold content | g/l | 5 | 8 | 10 | 10 | 10 | 10 |
| | en content | M | 1 | 1 | 1 | 2 | 2 | 2 |
| | Buffering agent | M | Acetic acid 0.3 | Citric acid 0.5 | Phosphoric acid 0.1 boric acid 0.1 | Acetic acid 0.3 | Acetic acid 0.3 | Succinic acid 0.1 Phosphoric acid 0.1 |
| | Brightener(*) | ppm | (1) 100 | (2) 500 | (3) 700 | (2) 700 | (2) 1,000 | (2) 2,000 |
| Conditions for plating | pH | — | 4 | 5 | 4.5 | 3.8 | 3 | 6 |
| | Temperature | ° C. | 60 | 65 | 70 | 50 | 65 | 65 |
| | Current density | $A/dm^2$ | 1 | 1 | 2 | 2 | 2 | 2 |
| | Appearance (**) | — | Bright | Semi-bright | semi-bright | Semi-bright | Semi-bright | Semi-bright |
| | Hardness | Hv | 100 | 70 | 70 | 70 | 70 | 70 |
| | Stability (***) | — | Good | Good | Good | Good | Good | Good |

(*)Types of brighteners used: (1) o-phenanthroline; (2) 2,2-bipyridyl; (3) 2,2-4-picoline (**)The results obtained by visual observation are shown.

(***)The stability was determined for variation in plating current measured after a current of 15,000 coulombs in total was applied to 1 liter of a plating solution and then the gold content was adjusted to the preselected value. The variation in current within 5% compared with the initial plating condition was defined as "good".

| | |
|---|---|
| pH: | 5.0 |
| Temperature of plating solution: | 60° C. |
| Current density: | 1.5 A/dm$^2$ |
| Time for electrolysis: | 60 min. |

The physical properties of the gold-plated layer prepared under the above-mentioned conditions were determined, and the results are shown in Table 3. As shown in Table 3, the average Vicker's hardness of the gold-plated layer was 66.7. The test pattern on the gold-plated layer after the gold plating was observed under a scanning electron microscope (SEM), and the result is shown in FIG. 1. As shown in FIG. 1, a very smooth gold-plated surface was formed. Since such a smoothness of a plated surface can be achieved, the bonding properties can be remarkably improved. The service life of the electrolytic gold plating solution was 3,100 hours, determined in terms of the current-carrying time.

Example 2

Bis(1,2-ethanediamine) gold trichloride, to be used as a gold salt, was produced by the following reaction at a reaction temperature of 30° C. In the reaction, the reaction temperature is preferably within the range from 15 to 60° C. If the reaction temperature is lower than 15° C., then the reaction cannot proceed satisfactorily and the yield may be reduced. If the reaction temperature is higher than 60° C., then a reduction reaction of gold ions may occur, causing the formation of microparticles of gold.

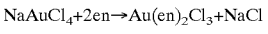

$$NaAuCl_4+2en \rightarrow Au(en)_2Cl_3+NaCl$$

The bis(1,2-ethanediamine) gold trichloride produced was used to prepare a bath of a non-cyanide gold plating solution. The non-cyanide electrolytic gold plating solution had the following composition.

| | |
|---|---|
| Bis (1,2-ethanediamine) gold trichloride (gold content) | 10 g/l |
| 1,2-Ethenadiamine sulfate | 100 g/l |
| Buffering agent (Citric acid) | 50 g/l |
| Organic brightener (o-Phenanthroline) | 100 ppm |

The gold plating solution was used to conduct gold plating in a test pattern under the following conditions.

| | |
|---|---|
| pH: | 3.50 |
| Temperature of plating solution: | 60° C. |
| Current density: | 1.0 A/dm$^2$ |
| Time for electrolysis: | 75 min. |

The physical properties of the gold-plated layer prepared under the above-mentioned conditions were determined, and the results are shown in Table 3. As shown in Table 3, the average Vicker's hardness of the gold-plated layer was 66.7. The service life of the electrolytic gold plating solution was 3,500 hours, determined in terms of the current-carrying time.

Example 3

Gold hydroxide was used as a gold salt. The gold content of the gold plating solution was adjusted to 8 g/l. The non-cyanide electrolytic gold plating solution had the following composition.

| | |
|---|---|
| Gold hydroxide (gold content) | 8 g/l |
| 1,2-Ethenadiamine dihydrochloride | 80 g/l |
| Buffering agent (Boric acid) | 30 g/l |
| Organic brightener (2,2-Bipyridyl) | 400 ppm |

The gold plating solution was used to conduct gold plating in a test pattern under the following conditions.

| | |
|---|---|
| pH: | 4.30 |
| Temperature of plating solution: | 55° C. |
| Current density: | 1.2 A/dm$^2$ |
| Time for electrolysis: | 75 min. |

The physical properties of the gold-plated layer prepared under the above-mentioned conditions were determined, and the results are shown in Table 3. As shown in Table 3, the average Vicker's hardness of the gold-plated layer was 72.1. The service life of the electrolytic gold plating solution was 3,450 hours, determined in terms of the current-carrying time.

Example 4

Potassium tetrahydroxoaurate was used as a gold salt. The gold content of the gold plating solution was adjusted to 10 g/l. The non-cyanide electrolytic gold plating solution had the following composition.

| | |
|---|---|
| Potassium tetrahydroxoaurate (gold content) | 10 g/l |
| 1,2-Ethenadiamine dihydrochloride | 120 g/l |
| Buffering agent (Boric acid) | 50 g/l |
| Organic brightener (2,2-Bipyridyl) | 1200 ppm |

The gold plating solution was used to conduct gold plating in a test pattern under the following conditions.

| | |
|---|---|
| pH: | 3.60 |
| Temperature of plating solution: | 65° C. |
| Current density: | 1.5 A/dm$^2$ |
| Time for electrolysis: | 75 min. |

The physical properties of the gold-plated layer prepared under the above-mentioned conditions were determined, and the results are shown in Table 3. As shown in Table 3, the average Vicker's hardness of the gold-plated layer was 73.0. The service life of the electrolytic gold plating solution was 3,300 hours, determined in terms of the current-carrying time.

Example 5

Chloroauric acid was used as a gold salt. The gold content of the gold plating solution was adjusted to 10 g/l. The non-cyanide electrolytic gold plating solution had the following composition.

| | |
|---|---|
| Chloroauric acid (gold content) | 10 g/l |
| 1,2-Ethenadiamine dihydrochloride | 150 g/l |
| Buffering agent (Boric acid) | 40 g/l |
| Organic brightener (2,2-Bipyridyl) | 1000 ppm |

The gold plating solution was used to conduct gold plating in a test pattern under the following conditions.

| | |
|---|---|
| pH: | 3.60 |
| Temperature of plating solution: | 60° C. |
| Current density: | 1.2 A/dm$^2$ |
| Time for electrolysis: | 75 min. |

The physical properties of the gold-plated layer prepared under the above-mentioned conditions were determined, and the results are shown in Table 3. As shown in Table 3, the average Vicker's hardness of the gold-plated layer was 70.5. The service life of the electrolytic gold plating solution was 3,100 hours, determined in terms of the current-carrying time.

Example 6

Both potassium tetrahydroxoaurate and chloroauric acid were used as gold salts. The total gold content of the gold plating solution was adjusted to 10 g/l. The non-cyanide electrolytic gold plating solution had the following composition.

| | |
|---|---|
| Potassium tetrahydroxoaurate (gold content) | 5 g/l |
| Chloroauric acid (gold content) | 5 g/l |
| 1,2-Ethenadiamine dihydrochloride | 120 g/l |
| Buffering agent (Dipotassium hydrogenphosphate) | 30 g/l |
| Organic brightener (2,2-Bipyridyl) | 400 ppm |

The gold plating solution was used to conduct gold plating in a test pattern under the following conditions.

| | |
|---|---|
| pH: | 6.0 |
| Temperature of plating solution: | 45° C. |
| Current density: | 1.0 A/dm$^2$ |
| Time for electrolysis: | 75 min. |

The physical properties of the gold-plated layer prepared under the above-mentioned conditions were determined, and the results are shown in Table 3. As shown in Table 3, the average Vicker's hardness of the gold-plated layer was 67.0. The service life of the electrolytic gold plating solution was 3,280 hours, determined in terms of the current-carrying time.

COMPARATIVE EXAMPLE

To compare the performance between a non-cyanide electrolytic gold plating solution according to the present invention, and a non-cyanide electrolytic gold plating solution according to the prior art, a bath of a gold plating solution was prepared using $Na_3Au(SO_3)_2$ as a gold salt, and gold plating was conducted in the same test pattern as in the above examples as a comparative example. The prior art non-cyanide electrolytic gold plating solution had the following composition.

| | |
|---|---|
| $Na_3Au(SO_3)_2$ (gold content) | 10 g/l |
| $Na_2SO_3$ | 20 g/l |
| $Na_2HPO_4$ | 20 g/l |
| Thallium | 0.01 g/l |

The solution was used to conduct gold plating in the test pattern under the following conditions.

| | |
|---|---|
| pH: | 7.5 |
| Temperature of plating solution: | 65° C. |
| Current density: | 0.5 A/dm$^2$ |
| Time for electrolysis: | 60 min. |

The service life of the gold plating solution and the physical properties of the gold-plated layer prepared under the above-mentioned conditions were determined. The results shown Table 3 are for a prior art non-cyanide gold plating solution. As shown in Table 3, the average Vicker's hardness of the gold-plated layer was 75.1. The service life of the prior art electrolytic gold plating solution was 1,000 to 2,000 hours, determined in terms of the current-carrying time, which is shorter than that of the non-cyanide electrolytic gold plating solution according to the present invention.

TABLE 3

| Samples | Service life of plating solution (Hr) | Vicker's hardness (Hv) | Visually observed appearance |
|---|---|---|---|
| Example 1 | 3,100 | 66.7 | Bright |
| Example 2 | 3,500 | 66.7 | Bright |
| Example 3 | 3,450 | 72.1 | Semi-bright |
| Example 4 | 3,300 | 73.0 | Semi-bright |
| Example 5 | 3,100 | 70.5 | Semi-bright |
| Example 6 | 3,280 | 67.0 | Semi-bright |
| Comparative Example | 1,790 | 75.1 | Semi-bright |

Figure 2:
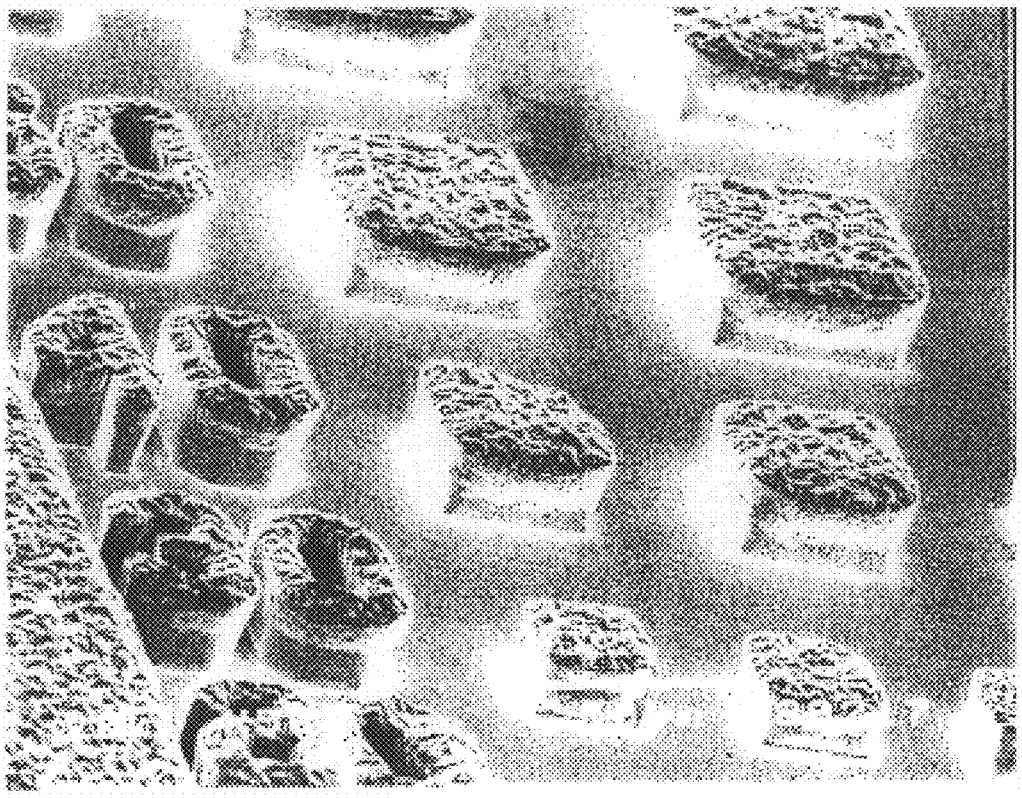
FIG. 2 shows the structure of deposited particles on the surface of a gold-plated layer observed in the same manner as for FIG. 1.

The test pattern obtained after the gold plating in the comparative example was observed under a scanning electron microscopy (SEM). The result is shown in FIG. 2. The comparison between FIG. 1 and FIG. 2 clearly demonstrates that a gold-plated surface formed using the prior art non-cyanide gold plating solution is less smooth compared with that formed using the non-cyanide gold plating solution according to the present invention.

EFFECT OF THE INVENTION

According to the present invention, a non-cyanide gold plating solution can be provided, which has excellent liquid stability and which causes no change in the physical properties of the deposited gold or no decomposition of the solution during the operation of gold plating. In addition, it also becomes possible to achieve a reduction in the cost required for the gold plating operation. By the addition of 1,2-ethanediamine to the gold plating solution, it becomes possible to control the hardness, purity and state of the deposited crystals, and to achieve appropriate bonding properties which are suitable for plating fine patterns.

What is claimed is:

1. A non-cyanide electrolytic gold plating solution comprising:

a gold compound selected from the group consisting of a gold salt and a gold complex as a source material for gold;

a buffering agent;

an organic brightener; and a conductive salt, 1,2-ethanediamine being contained in the plating solution.

2. The non-cyanide electrolytic gold plating solution according to claim 1, wherein the gold plating solution comprises:

a bis(1,2-ethanediamine) gold complex, as the gold compound, in such an amount that the gold content in the gold plating solution falls within the range from 2 to 30 g/l;

1,2-ethanediamine sulfate at a concentration of 0.1 to 2.5 M;

an inorganic potassium salt as the conductive salt;

an organic carboxylic acid as the buffering agent; and a heterocyclic compound containing at least one heteroatom as the organic brightener.

3. The non-cyanide electrolytic gold plating solution according to claim 2, wherein the inorganic potassium salt as the conductive salt is a compound selected from the group consisting of potassium sulfate, potassium chloride and potassium nitrate at a concentration of 1 to 100 g/l in the gold plating solution.

4. The non-cyanide electrolytic gold plating solution according to claim 2, wherein the organic carboxylic acid as the buffering agent is a compound having a carboxyl group selected from the group consisting of acetic acid, formic acid and benzoic acid at a concentration of 1 to 200 g/l in the gold plating solution.

5. The non-cyanide electrolytic gold plating solution according to claim 2, wherein the heterocyclic compound having at least one heteroatom as the organic brightener is a compound selected from the group consisting of thiophenecarboxylic acid, o-phenanthroline, pyridine, pyridinesulfonic acid and bipyridyl at a concentration of 0.1 to 10 g/l in the gold plating solution.

6. A process for non-cyanide electrolytic gold plating comprising applying a non-cyanide electrolytic gold plating solution as claimed in claim 2 to a substrate, under conditions of (a) the pH of the gold plating solution is 2 to 7, (b) the temperature of the gold plating solution is 40 to 80° C., and (c) the plating current density is 0.2 to 3.5 A/dm$^2$.

7. The non-cyanide electrolytic gold plating solution according to claim 1, wherein the gold plating solution comprises:

a trivalent gold salt in such an amount that the gold content in the gold plating solution falls within the range from 5 to 30 g/l;

1,2-ethanediamine at a concentration of 0.2 to 3.0 M;

the buffering agent;

the organic brightener; and the conductive salt.

8. The non-cyanide electrolytic gold plating solution according to claim 7, wherein the trivalent gold salt is one or more compounds selected from the group consisting of bis(1,2-ethanediamine) gold chloride, gold hydroxide, potassium tetrahydroxoaurate and chloroauric acid.

9. The non-cyanide electrolytic gold plating solution according to claim 7, wherein the buffering agent is one or more compounds selected from the group consisting of an organic carboxylic acid having a pK value of 2 to 6, a phosphoric acid and boric acid, and is contained in the gold plating solution at a total molar concentration of 0.05 to 1.0 M.

10. The non-cyanide electrolytic gold plating solution according to claim 7, wherein the organic brightener is one or more compounds selected from the group consisting of o-phenanthroline, bipyridyl, and is contained in the gold plating solution at a total concentration of 50 to 10,000 ppm.

11. The non-cyanide electrolytic gold plating solution according to claim 7, wherein the conductive salt is one or more compounds capable of supplying a sulfate ion, a hydrochloride ion or a nitrate ion, and is contained in the gold plating solution at a total molar concentration of 0.05 to 5.0 M.

12. A process for non-cyanide electrolytic gold plating comprising plating a non-cyanide electrolytic gold plating solution as claimed in claim 7 on a substrate under conditions of (a) the pH of the gold plating solution is 2 to 6, (b) the temperature of the gold plating solution is 40 to 70° C., and (c) the plating current density is 0.1 to 3.0 A/dm$^2$.

13. A non-cyanide electrolytic gold plating solution comprising:

a gold compound selected from the group consisting of a gold salt and a gold complex as a source material for gold;

a buffering agent;

an organic brightener; and a conductive salt, said conductive salt being an inorganic potassium salt;

wherein 1,2-ethanediamine is contained in the plating solution.

14. The non-cyanide electrolytic gold plating solution of claim 13, wherein the inorganic potassium salt is selected from the group consisting of potassium sulfate, potassium chloride, and potassium nitrate.

* * * * *